US012162810B2

(12) United States Patent
Zhang

(10) Patent No.: US 12,162,810 B2
(45) Date of Patent: Dec. 10, 2024

(54) NOCTILUCENT BANG SNAPS AND PREPARATION METHODS THEREOF

(71) Applicant: American Promotional Events, Inc., Florence, AL (US)

(72) Inventor: Lei Zhang, Changsha (CN)

(73) Assignee: American Promotional Events, Inc., Florence, AL (US)

( * ) Notice: Subject to any disclaimer, the term of this patent is extended or adjusted under 35 U.S.C. 154(b) by 170 days.

(21) Appl. No.: 17/931,813

(22) Filed: Sep. 13, 2022

(65) Prior Publication Data

US 2023/0093401 A1 Mar. 23, 2023

(51) Int. Cl.

| | |
|---|---|
| ***C06B 45/08*** | (2006.01) |
| ***C06B 21/00*** | (2006.01) |
| ***C06B 33/02*** | (2006.01) |

(52) U.S. Cl.
CPC ..... *C06B 45/08* (2013.01); *C06B 21/0041* (2013.01); *C06B 33/02* (2013.01)

(58) Field of Classification Search
CPC ..... C06B 45/08; C06B 21/0041; C06B 33/02
USPC ..... 102/361
See application file for complete search history.

(56) References Cited

FOREIGN PATENT DOCUMENTS

CN 113636901 A * 11/2021 ..... C06B 21/0041

* cited by examiner

*Primary Examiner* — Samir Abdosh
(74) *Attorney, Agent, or Firm* — Husch Blackwell LLP

(57) ABSTRACT

Provided herein are noctilucent bang snaps capable of producing flashing light when thrown into the air after a short duration of light absorption and staying luminous for 30 minutes when scattered on the ground after falling and explosion, in order to provide the effects of nighttime visibility and ornament. A preparation method of the noctilucent bang snap is also provided that has the advantages of operational simplicity, technical stability, easy availability of raw materials, product excellence, and extremely high commercial value.

14 Claims, No Drawings

NOCTILUCENT BANG SNAPS AND PREPARATION METHODS THEREOF

CROSS-REFERENCE TO RELATED APPLICATIONS

This application claims priority to Chinese Patent Application No. 202111073163.9, filed Sep. 14, 2021, titled NOCTILUCENT BANG SNAPS AND PREPARATION METHODS THEREOF, the entirety of which is hereby incorporated by reference.

FIELD OF THE INVENTION

The present invention relates to the field of bang snap preparation technologies and, more particularly, to a noctilucent bang snaps and preparation methods thereof.

BACKGROUND OF THE INVENTION

Also referred to as cherry bomb firecrackers, bang snaps are a type of small firecrackers capable of producing a loud "crackling" sound by being hand-twisted, stepped on, or gently thrown on a hard surface without ignition, and they are smokeless, odorless and non-sparking.

Currently available bang snaps are inconvenient to use at night, because due to insufficient illumination their falling points can hardly be perceptible, their "crackling" sound has a tendency to frighten others, and all these make them non-ornamental.

At present, no bang snaps on the market are capable of producing flashing light when thrown into the air after a short duration of light absorption and staying luminous for 30 minutes when scattered on the ground after falling and explosion, in order to provide the effects of nighttime visibility and ornament.

SUMMARY OF THE INVENTION

To overcome the deficiency of prior art, the present invention provides a noctilucent bang snap and preparation methods thereof. The noctilucent bang snaps provided by the present invention are capable of producing flashing light when thrown into the air after a short duration of light absorption and staying luminous for 30 minutes when scattered on the ground after falling and explosion.

The noctilucent bang snap may comprise silver in a concentration of from about 1% by weight to about 2% by weight, for example, from about 1.5% by weight to about 2% by weight.

The noctilucent bang snap may comprise sand in a concentration of from about 85% by weight to about 90% by weight, for example, from about 88% by weight to about 89% by weight.

The noctilucent bang snap may comprise ethanol in a concentration of from about 5% by weight to about 7% by weight, for example, from about 5.5% by weight to about 6% by weight.

The noctilucent bang snap may comprise nitric acid in a concentration of from about 1% by weight to about 2% by weight, for example, from about 1.5% by weight to about 2% by weight.

The noctilucent bang snap may comprise noctilucent stone in a concentration of from about 1.5% by weight to about 3% by weight, for example, from about 2% by weight to about 2.5% by weight.

For example, the noctilucent bang snap may comprise the following raw material constituents in terms of parts by weight: silver, in a concentration of from about 250 to about 300 parts by weight, sand, in a concentration of from about 14650 to about 14750 parts by weight, ethanol, in a concentration of from about 950 to about 980 parts by weight, nitric acid, in a concentration of from about 270 to about 300 parts by weight, and noctilucent stone, in a concentration of from about 350 to about 370 parts by weight.

Preferably, the sand is river sand or yellow sand.

Preferably, the sand has a particle size sufficient to pass through a number 8 mesh sieve opening; and the noctilucent stone a particle size sufficient to pass through a number 8 mesh sieve opening. Preferably, the sand has a particle size sufficient to pass through a number 10 mesh sieve opening; and the noctilucent stone a particle size sufficient to pass through a number 10 mesh sieve opening.

Preferably, the noctilucent bang snap comprises the following raw material constituents in terms of parts by weight: silver 274 parts, sand 14693 parts, ethanol 965 parts, nitric acid 285 parts, and noctilucent stone 360 parts.

Preferably, the noctilucent bang snap comprises the following raw material constituents in terms of parts by weight: silver 250 parts, sand 14650 parts, ethanol 950 parts, nitric acid 270 parts, and noctilucent stone 350 parts.

Preferably, the noctilucent bang snap comprises the following raw material constituents in terms of parts by weight: silver 300 parts, sand 14750 parts, ethanol 980 parts, nitric acid 300 parts, and noctilucent stone 370 parts.

A preparation method of the noctilucent bang snap as defined above, comprising the following steps:

S1—add and dissolve silver in nitric acid, add ethanol into the solution to produce a silver fulminate (AgCNO) solution;

S2—add sand into the silver fulminate (AgCNO) solution, stir for the first time, air-cure the mixture, add noctilucent stone to the mixture and stir for the second time to produce a sand and gravel mixture;

S3—pack the sand and gravel mixture to obtain the noctilucent bang snap.

Preferably, in step S2, the first stir is performed at a stirring rate of about 40~50 rpm for about 30 minutes; the second stir is performed at a stirring rate of about 40~50 rpm for about 30 minutes; and the air curing is performed at a temperature of about 15~30° C. for about 1 hour.

Preferably, in step S3, the weight of the noctilucent bang snap is about 0.34 g per pellet.

The beneficial effects of the present invention are: (1) the noctilucent bang snaps provided by the present invention only need to absorb light for 1 minute in the day or absorb indoor light for 5 minutes at night to be able to produce flashing light when thrown into the air after a short duration of light absorption and stay luminous for at least about 30 minutes when scattered on the ground after falling and explosion, in order to provide the effects of nighttime visibility and ornament; and (2) the preparation method of the noctilucent bang snap provided by the present invention have the advantages of operational simplicity, technical stability, easy availability of raw materials, product excellence, and extremely high commercial value.

DETAILED DESCRIPTION OF THE INVENTION

Embodiments of the technical scheme of the present invention are described in detail below. The following embodiments are merely intended to better illustrate the technical scheme of the present invention, and are exemplary of the present invention and not limiting the scope of protection thereof.

It must be noted that unless otherwise stated, the technical terminology or scientific terminology used herein shall have the meanings as understood by persons skilled in the art.

Embodiment 1

A noctilucent bang snap, comprising the following raw material constituents in terms of parts by weight:

Silver 274 parts, sand 14693 parts, ethanol 965 parts, nitric acid 285 parts, and noctilucent stone 360 parts.

The sand is river sand.

The sand has a size of a number 8 mesh sieve opening; the noctilucent stone has a size of a number 8 mesh sieve opening.

A preparation method of the noctilucent bang snap as defined above, comprising the following steps:

S1—add and dissolve silver in nitric acid, add ethanol into the solution to produce a silver fulminate (AgCNO) solution;

S2—add sand into the silver fulminate (AgCNO) solution, stir for the first time, air-cure the mixture, add noctilucent stone to the mixture and stir for the second time to produce a sand and gravel mixture;

S3—pack the sand and gravel mixture to obtain the noctilucent bang snap.

In step S2, the first stir is performed at a stirring rate of 45 rpm for 30 minutes; the second stir is performed at a stirring rate of 45 rpm for 30 minutes; and the air curing is performed at a temperature of 25° C. for 1 hour.

In step S3, the weight of the noctilucent bang snap is 0.34 g per pellet.

Embodiment 2

A noctilucent bang snap, comprising the following raw material constituents in terms of parts by weight:

Silver 250 parts, sand 14650 parts, ethanol 950 parts, nitric acid 270 parts, and noctilucent stone 350 parts.

The sand is river sand.

The sand has a size of a number 10 mesh sieve opening; the noctilucent stone has a size of a number 10 mesh sieve opening.

A preparation method of the noctilucent bang snap as defined above, comprising the following steps:

S1—add and dissolve silver in nitric acid, add ethanol into the solution to produce a silver fulminate (AgCNO) solution;

S2—add sand into the silver fulminate (AgCNO) solution, stir for the first time, air-cure the mixture, add noctilucent stone to the mixture and stir for the second time to produce a sand and gravel mixture;

S3—pack the sand and gravel mixture to obtain the noctilucent bang snap.

In step S2, the first stir is performed at a stirring rate of 45 rpm for 30 minutes; the second stir is performed at a stirring rate of 45 rpm for 30 minutes; and the air curing is performed at a temperature of 25° C. for 1 hour.

In step S3, the weight of the noctilucent bang snap is 0.32 g per pellet.

Embodiment 3

A noctilucent bang snap, comprising the following raw material constituents in terms of parts by weight:

Silver 300 parts, sand 14750 parts, ethanol 980 parts, nitric acid 300 parts, and noctilucent stone 370 parts.

The sand is river sand.

The sand has a size of a number 8 mesh sieve opening; the noctilucent stone has a size of a number 8 mesh sieve opening.

A preparation method of the noctilucent bang snap as defined above, comprising the following steps:

S1—add and dissolve silver in nitric acid, add ethanol into the solution to produce a silver fulminate (AgCNO) solution;

S2—add sand into the silver fulminate (AgCNO) solution, stir for the first time, air-cure the mixture, add noctilucent stone to the mixture and stir for the second time to produce a sand and gravel mixture;

S3—pack the sand and gravel mixture to obtain the noctilucent bang snap.

In step S2, the first stir is performed at a stirring rate of 45 rpm for 30 minutes; the second stir is performed at a stirring rate of 45 rpm for 30 minutes; and the air curing is performed at a temperature of 25° C. for 1 hour.

In step S3, the weight of the noctilucent bang snap is 0.3 g per pellet.

EXAMPLES OF EXPERIMENTS

Measurement of light emission durations of noctilucent bang snaps prepared in Embodiments 1~3

Test method: the noctilucent bang snaps prepared in Embodiments 1~3 were placed under fluorescent light for 5 minutes prior to their use outdoor at night, and the light emission durations were measured with the results shown in Table 1.

TABLE 1

| | Light Emission Duration (minutes) |
|---|---|
| Embodiment 1 | 31 |
| Embodiment 2 | 29 |
| Embodiment 3 | 30 |

Lastly, it must be noted that: the foregoing embodiments are merely intended to illustrate the technical scheme of the present invention instead of limiting it. While the present invention has been described in detail with reference to the foregoing embodiments, it should be understood by persons of ordinary skill in the art that modifications or equivalent replacements can be made to some or all portions of the technical scheme recorded therein, and these modifications or equivalent replacements do not result in any departure of the essence of the technical scheme from the scopes of the various embodiments and should fall within the scope of protection of the claims and description of the present invention.

What is claimed is:

1. A noctilucent bang snap comprising:

silver, in a concentration of from 1% by weight to 2% by weight, sand, in a concentration of from 85% by weight to 90% by weight, ethanol, in a concentration of from 5% by weight to 7% by weight, nitric acid, in a concentration of from 1% by weight to 2% by weight, and noctilucent stone, in a concentration of from 1.5% by weight to 3% by weight.

2. The noctilucent bang snap of claim 1 comprising:
silver, in a concentration of from 1.5% by weight to 2% by weight,
sand, in a concentration of from 88% by weight to 89% by weight,
ethanol, in a concentration of from 5.5% by weight to 6% by weight,
nitric acid, in a concentration of from 1.5% by weight to 2% by weight, and
noctilucent stone, in a concentration of from 2% by weight to 2.5% by weight.

3. The noctilucent bang snap of claim 1 comprising:
silver, in a concentration of from 250 to 300 parts by weight,
sand, in a concentration of from 14650 to 14750 parts by weight,
ethanol, in a concentration of from 950 to 980 parts by weight,
nitric acid, in a concentration of from 270 to 300 parts by weight, and
noctilucent stone, in a concentration of from 350 to 370 parts by weight.

4. The noctilucent bang snap of claim 1 wherein the sand is selected from the group consisting of river sand, yellow sand, and combinations thereof.

5. The noctilucent bang snap of claim 1 wherein the sand has a particle size sufficient to pass through a number 8 mesh sieve opening; and
the noctilucent stone a particle size sufficient to pass through a number 8 mesh sieve opening.

6. The noctilucent bang snap of claim 5 wherein the sand has a particle size sufficient to pass through a number 10 mesh sieve opening; and
the noctilucent stone a particle size sufficient to pass through a number 10 mesh sieve opening.

7. The noctilucent bang snap of claim 1 comprising:
silver, in a concentration of 274 parts by weight,
sand, in a concentration of 14693 parts by weight,
ethanol, in a concentration of 965 parts by weight,
nitric acid, in a concentration of 285 parts by weight, and
noctilucent stone, a concentration of 360 parts by weight.

8. The noctilucent bang snap of claim 1 comprising:
silver, in a concentration of 250 parts by weight,
sand, in a concentration of 14650 parts by weight,
ethanol, in a concentration of 950 parts by weight,
nitric acid, in a concentration of 270 parts by weight, and
noctilucent stone, a concentration of 350 parts by weight.

9. The noctilucent bang snap of claim 1 comprising:
silver, in a concentration of 300 parts by weight,
sand, in a concentration of 14750 parts by weight,
ethanol, in a concentration of 980 parts by weight,
nitric acid, in a concentration of 300 parts by weight, and
noctilucent stone, a concentration of 370 parts by weight.

10. A preparation method of the noctilucent bang snap of claim 1, comprising the following steps:
(S1) add and dissolve silver in nitric acid, and combine the resulting solution with ethanol to produce a silver fulminate (AgCNO) solution;
(S2) add sand into the silver fulminate (AgCNO) solution, stir for the first time, air-cure the mixture, add noctilucent stone to the mixture, and stir for the second time to produce a sand and gravel mixture;
(S3) pack the sand and gravel mixture to obtain the noctilucent bang snap.

11. The noctilucent bang snap of claim 10, wherein in step S2, the first stir is performed at a stirring rate of from 40 to 50 rpm for a period of 30 minutes.

12. The noctilucent bang snap of claim 10, wherein in step S2, the second stir is performed at a stirring rate of from 40 to 50 rpm for a period of 30 minutes.

13. The noctilucent bang snap of claim 10, wherein in step S2, the air curing is performed at a temperature of from 15° C. to 30° C. for a period of 1 hour.

14. The noctilucent bang snap of claim 10, wherein in step S3, the weight of the noctilucent bang snap is from 0.3 grams to 0.34 grams per pellet.

* * * * *